US005243151A

United States Patent [19]

Prokisch

[11] Patent Number: 5,243,151

[45] Date of Patent: Sep. 7, 1993

[54] CONICAL LOUDSPEAKER

[75] Inventor: Jorg Prokisch, Schwarzach, Fed. Rep. of Germany

[73] Assignee: Nokia Technology GmbH, Pforzheim, Fed. Rep. of Germany

[21] Appl. No.: 962,275

[22] Filed: Oct. 16, 1992

[30] Foreign Application Priority Data

Oct. 19, 1991 [DE] Fed. Rep. of Germany ... 9113037[U]

[51] Int. Cl.[5] ..... H04R 7/16

[52] U.S. Cl. ..... 181/171; 381/188; 381/205

[58] Field of Search ..... 181/150, 161, 171, 172, 181/198; 381/188, 193, 194, 205

[56] References Cited

U.S. PATENT DOCUMENTS

| | | | |
|---|---|---|---|
| 4,387,788 | 6/1983 | Slavin et al. | 181/171 |
| 4,520,237 | 5/1985 | Murakami | 181/194 |
| 5,099,949 | 3/1992 | Mitobe | 181/171 |

*Primary Examiner*—Michael L. Gellner
*Assistant Examiner*—Khanh Dang
*Attorney, Agent, or Firm*—Ware, Fressola, Van Der Sluys & Adolphson

[57] ABSTRACT

A secure joint between heavy magnet systems (11) and plastic loudspeaker frames (12) in conical loudspeakers (10) is conventionally implemented as an adhesive joint or as a shaved rivet joint. These types of joint are disadvantageous, since solvents are necessary when the components are adhesively bonded, and expensive plastics must be used for the shaved rivet joint. Residue-free separation of components joined in this manner is also difficult. Joints that create a secure joint on the basis of mechanically acting components alone are therefore indicated. According to one embodiment of the invention, the magnet system (11) is set into a plastic shroud (31) that has a convex base (32) and a crenelated rim region (36). The higher rim segments (37.2) are guided through openings (38) in the frame base (18) and expanded like rivet heads above the frame base (18), while the other rim segments (37.1) rest on the frame base (18). Since the curvature of the shroud base (32) is reduced by the action of an external force while the rivet heads (39) are being formed, when this external force is removed, the return force in the shroud base (32) causes the magnet system (11) to be permanently and securely seated on the loudspeaker (12).

5 Claims, 2 Drawing Sheets

10

CONICAL LOUDSPEAKER

TECHNICAL FIELD

Figure 1:
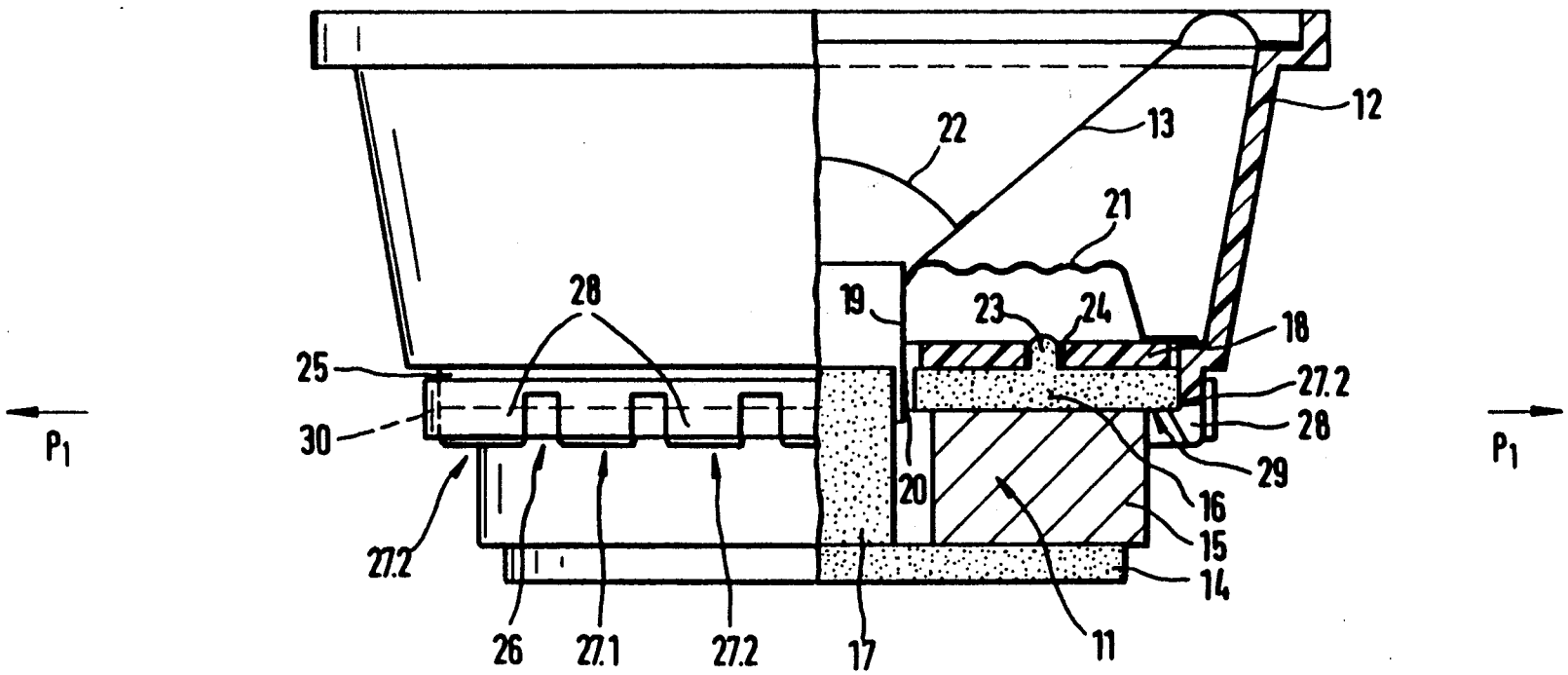

The invention concerns the structure of conical loudspeakers, in particular environmentally-friendly joining of the loudspeaker frame and magnet system.

BACKGROUND OF THE INVENTION

Conical loudspeakers have been known for some time in the prior art, and therefore do not require detailed discussion with regard to their structure and operation. For better comprehension, however, it should be mentioned at this point that conical loudspeakers ordinarily consist of a magnet system, a loudspeaker frame, and a membrane onto which the moving coil is applied. The conical loudspeaker frame is conventionally made of either metal or plastic. The magnet system consists of an annular permanent magnet, and upper pole plate (made of metal and also annular), and a circular lower pole plate that is also made of metal. The two pole plates are joined to the annular surfaces of the permanent magnet. Also present is a circular pole core, one end of which is joined to the lower pole plate, and which is encased over its entire length, at a distance, by the inner contour of the upper pole plate and permanent magnet.

The base of the loudspeaker frame is joined to the surface facing away from the permanent magnet. In the prior art, this joint is effected as a rivet joint if the loudspeaker frame is made of metal. For this purpose, "rivet lugs" are formed on the surface of the upper pole plate facing away from the permanent magnet, and are guided through corresponding openings in the frame base. The region of the particular rivet lug that projects out from the frame base is expanded by riveting, and thereby clamps the frame base against the upper pole plate. In addition, the rivet lugs center the upper pole plate on the loudspeaker frame.

It is impossible, or possible only at the cost of considerable disadvantages, to transfer the aforementioned joint between loudspeaker frame and magnet system to loudspeaker frames that are made of plastic. Whereas the riveting procedure is designed to press the upper pole plate gently against the frame base, the forces required for that purpose acting on the rivet bumps and the frame base during the riveting process are so great that the frame base breaks.

To eliminate these problems —which are particularly common in large-scale series production of loudspeakers—the prior art indicates two possible solutions which guarantee that the loudspeaker magnet systems, which in some cases are heavy, can be secured to the frame base with sufficient security.

According to the first approach, the loudspeaker frame is adhesively bonded to the magnet system. Two-component adhesives are usually used for this purpose; in order to maintain production, they require large quantities of solvents and rinsing agents to keep the adhesive nozzle clear.

With the second approach, a "shaved rivet" joint is made to join the magnet system and loudspeaker frame. To do so, the rivet bumps are pressed into the corresponding openings in the frame base. This type of joint, however, demands the use of high-quality plastics for the loudspeaker frame, so as to prevent cold forming of the plastic with accompanying loosening of the joint. Plastics that exhibit the material characteristics suitable for this purpose are polycarbonates or glass fiber-reinforced polycarbonates. Aside from the fact that these polycarbonates are very expensive in comparison to other plastics, they are also not entirely without hazard from an environmental point of view, since this material is more or less non-degradable. If polycarbonate is used as a material for the loudspeaker frame, and if the loudspeaker frame later needs to be separated from the magnet system again, residues of the frame base will, as with the previously discussed solution using adhesive bonding, inevitably remain behind on the magnet system unless complex separation processes are implemented. As a result, the magnet systems are no longer available for re-use after they have been separated from the loudspeaker frame. The portions of the frame remaining behind on the magnet system are likewise permanently excluded from potential recycling processes for frame materials.

SUMMARY OF THE INVENTION

The object on which the invention is based is therefore to provide a conical loudspeaker that eliminates the disadvantages of the loudspeakers mentioned earlier, and joins the magnet system securely to the loudspeaker frame even when the magnet system is large and heavy.

This object is achieved by the features and combinations of features shown in the drawings.

When the joint between loudspeaker frame and magnet system is made according to the invention, even large and heavy magnet systems of conical loudspeakers, up to 20 cm in diameter, can be securely and permanently joined to the loudspeaker frame. As drop tests have shown, despite the capability for separating the loudspeaker frame from the magnet system easily and with no residue, there is no danger that the magnet system will separate from the loudspeaker frame while the loudspeaker is in operation.

THE DRAWINGS

Figure 2:
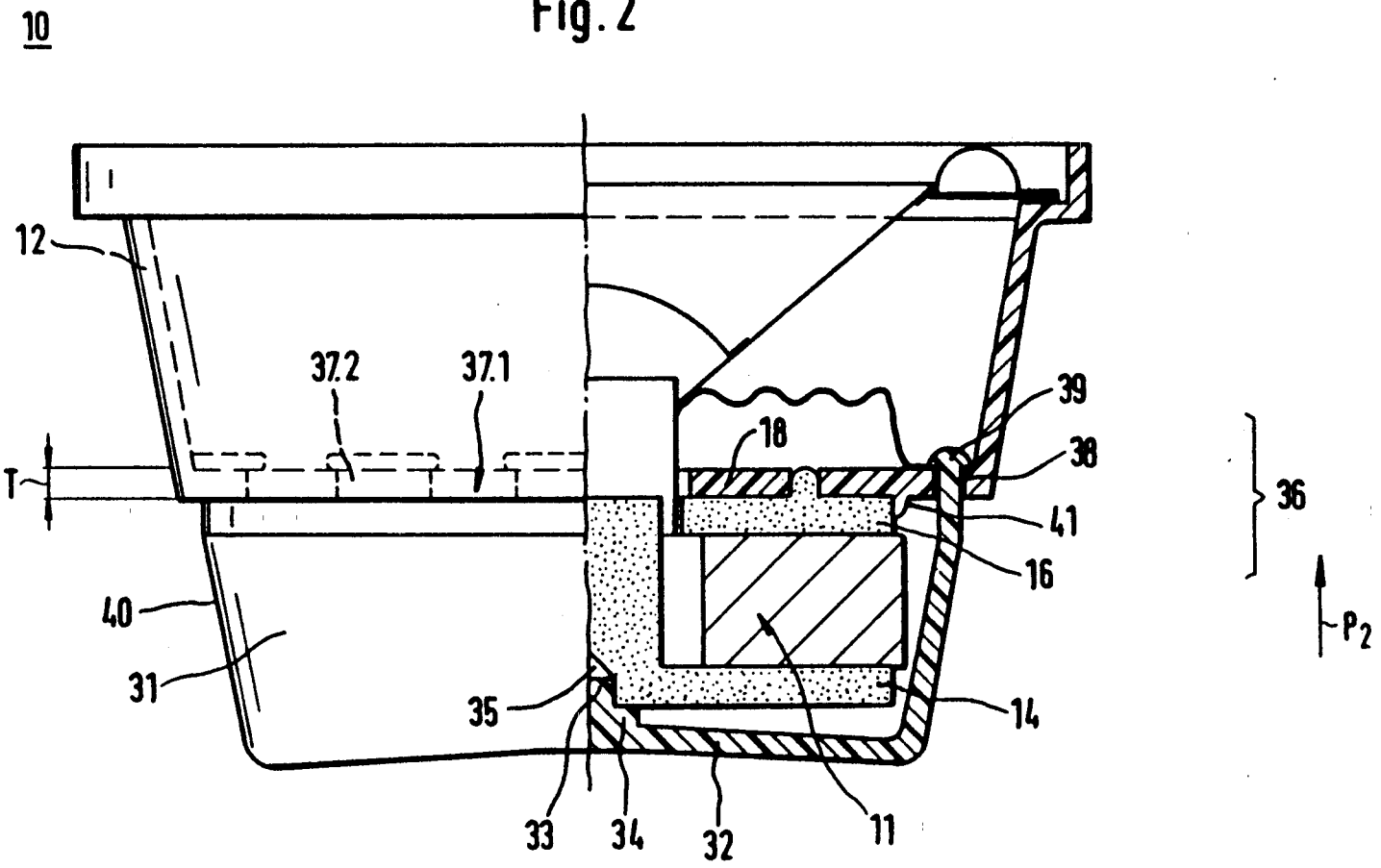

In the Figures:

FIG. 1 shows a side view of a conical loudspeaker, with the right half of the loudspeaker depicted in section; and FIG. 2 shows a further conical loudspeaker, likewise with the right half depicted in section.

BEST MODES FOR CARRYING OUT THE INVENTION

The conical loudspeaker 10 shown in FIG. 1 consists essentially of the magnet system 11, a conical loudspeaker frame 12 made of plastic, and a membrane 13. The magnet system 11 is of ordinary configuration, and consists of a circular pole plate 14, an annular permanent magnet 15, an upper pole plate 16 (also annular in shape), and a round pole core 17. The two pole plates 14, 16 are arranged and joined, concentrically to the central axis of the loudspeaker, on the two annular surfaces of the permanent magnet 15. The pole core 17 is joined to the lower pole plate 14, and is encircled over its entire height, at a distance, by the inner contours of the permanent magnet 15 and upper pole plate 16.

The base 18 of the loudspeaker frame 12 is placed on the side of the upper pole plate 16 which faces away from the permanent magnet 15. The manner in which the upper pole plate 16 is joined to the loudspeaker frame 12 is presented later on. The membrane 13, also conical in shape, is set within the loudspeaker frame 12, with the greater diameter of the membrane 13 joined to the upper rim of the loudspeaker frame 12. Attached at the small central opening of the membrane 13 is the tubular moving coil carrier 19, the free end of which is encased by the moving coil 20. The length of the moving coil carrier 19 is such that, with the loudspeaker in its rest position, its free end projects into the gap formed by the pole core 17 on one side and by the upper pole plate 16 and the permanent magnet 15 on the other side. In order to center the membrane 13, the frame base 18 is joined to the peripheral surface of the moving coil carrier 19 by means of a corrugated centering membrane 21. In addition, a dust protection cap 22 is bonded onto the inner contour of the membrane 13. Moreover, the upper pole plate 16 has projecting pins 23 on the surface facing away from the permanent magnet 15. These pins slide into corresponding openings 24 in the frame base 18 when the base 18 is placed on the upper pole plate 16. These pins 23 and openings 24 do not perform any fastening function, but rather serve only to define the position of the loudspeaker frame 12 on the upper pole plate 16.

The joint between loudspeaker frame 12 and magnet system 11 is effected as follows:

Formed onto the surface of the frame base 18 that faces the magnet system is a circumferential rim 25, the inside diameter of which is just slightly greater than the outside diameter of the upper pole plate, and the height of which projects below the thickness of the upper pole plate 16. This rim 25 is divided, by a plurality of slits 26 running parallel to the center axis of the loudspeaker, into two types of segments 27.1 and 27.2. Every second segment 27.2 is configured as a snap catch 28. For this purpose, the free end region of this segment 27.2 is provided with a sawtooth-shaped projection facing towards the center axis of the loudspeaker. When the loudspeaker frame 12 is placed on the upper pole plate 16, the regions of the sawteeth extending at right angles to the center axis of the loudspeaker engage in projections 29 on the magnet system 11, and clamp the magnet system 11, by means of the upper pole plate 16, gently against the base 18 of the loudspeaker frame 12. In this embodiment, the projections 29 are implemented by the fact that the upper pole plate 16 has an outside diameter greater than that of the permanent magnet 15. With this physical configuration of the upper pole plate 16 with respect to the permanent magnet 15, separate implementation of projections 29 on the peripheral surface of the magnet system 11 can be dispensed with. It is plainly evident that assembly of the loudspeaker frame 12 and magnet system 11 is greatly simplified by the configuration of the loudspeaker frame 12 according to the invention. The reason is that when the loudspeaker frame 12 is slid onto the magnet system, the segments 27.2, which are configured as snap catches 28, initially deflect in the direction of arrow P1 over the projecting upper pole plate 16, and then, when the loudspeaker frame 12 has reached its final position on the magnet system 11, encompass the upper pole plate 16 and clamp it against the frame base 18. To prevent deflection of the segments 27.2 (configured as snap catches 28) while the loudspeaker is in operation, an interferingly tight band or strap 30 is applied around the peripheral surface of all the segments 27.1, 27.2, resiliently pressing the segments 27.1, 27.2 against the peripheral surface of the magnet system 11.

The loudspeaker 10 depicted in FIG. 2 differs from the loudspeaker depicted in FIG. 1 only in having a different type of fastening between the magnet system 11 and loudspeaker frame 12, so that in the context of explaining this embodiment, no further discussion of the general structure of the loudspeaker is required.

To join the magnet system 11 to the loudspeaker frame 12, the magnet system 11 is set into a cup-shaped shroud 31 made of plastic. The base 32 of the shroud 31 is convex on the inside, and has a mandrel 33 at the center of its inside surface. This mandrel 33 has, at its end that is joined to the shroud base 32, a disk-shaped swelling 34 that exceeds the diameter of the mandrel and acts as a spacer. The lower pole plate 14, which is provided for the purpose with a blind hole 35, is pushed onto the mandrel 33 so that the lower pole plate 14 rests only on the disk-shaped swelling 34.

The rim 36 of the shroud is crenelated, forming higher and lower rim segments 37.1 and 37.2. When the loudspeaker frame 12 is joined to the magnet system 11, the lower rim segments 37.1 rest on the surface of the frame base 18 facing the magnet system 11. In this position, the higher rim segments 37.2 are pushed through corresponding openings 38 in the frame base 18, and their cross section is expanded, like a rivet head, above the frame base 18 by ultrasonic welding, so that the underside of the rivet head 39 is in contact with the frame base 18.

Compressive thrust forces indicated by the force arrow P2 act within the peripheral surface 40 of the shroud 31. These forces are created during the joining of the loudspeaker frame 12 and magnet system 11 by decreasing the curvature of the convex shroud base 32 through application of an external force upward against the rim of base 32. Once the rivet heads 39 have been created by ultrasonic welding and the externally applied force on the shroud base 32 is removed, the return force with which the shroud base 32 resiliently attempts to regain its original curvature creates tensile forces P2 in the peripheral surface 40. As these forces P2 are transmitted through the shroud base 32 and the disk-shaped swelling 33 to the lower pole plate 14, the lower pole plate 16 of the magnet system 11 is clamped against the side of the frame base 18 facing the said pole plate 16.

By adjusting the thickness of the disk-shaped swelling 33 to the depth T of the cutouts in the rim segments 37.2, it is possible to ensure that while the external force is applied to the shroud base 32 as the magnet system 11 and loudspeaker frame 12 are being joined, the inner contour of the shroud base 32 cannot contact the lower pole plate 14.

For the sake of completeness, it should be noted that the frame base 18 is equipped, on its surface facing the magnet system 11, with a centering ring 41 that closely surrounds the upper pole plate 16. For reasons of clarity, the contacts for the moving coil 20 were not depicted in either of the Figures.

It will thus be seen that the objects set forth above, and those made apparent from the preceding description, are efficiently attained and, since certain changes may be made in the above article without departing from the scope of the invention, it is intended that all matter contained in the above description (or shown in the accompanying drawings) shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. Conical loudspeaker, with a magnet system (11) and with a loudspeaker frame (12) made of plastic that is joined to the magnet system (11), characterized in that the surface of the loudspeaker frame (12) that faces the magnet system (11) has a plurality of snap catches (28) that are attached behind projections (29) arranged on the peripheral surface of the magnet system (11) when the magnet system (11) is snapped together with the loudspeaker frame (12), and that the snap catches (28) snapped into place behind the projections (29) are pressed by means of a circumferential strap (30) against the peripheral surface of the magnet system (11) and into the projections (29).

2. Conical loudspeaker according to claim 1, characterized in that the upper pole plate (16) has an outside diameter greater than that of the permanent magnet (15).

3. Conical loudspeaker, with a magnet system (11) and with a loudspeaker frame (12) made of plastic that is joined to the magnet system (11), characterized in that the magnet system (11) is set into a cup-shaped shroud (31), the base (32) of which is slightly convex on the inside and the rim (36) of which is guided at least partially through corresponding openings (38) in the base (18) of the loudspeaker frame (12) and whose rim segments (37.2) emerging from the openings (38) rest on the surface of the frame base (18) facing away from the upper pole plate (16).

4. Conical loudspeaker according to claim 3, characterized in that the rim segments (37.2) resting on the frame base are expanded like rivet heads, for example by ultrasonic welding.

5. Conical loudspeaker according to claim 3 characterized in that the magnet system (11) is pushed onto a mandrel (33), that a spacer which spaces the magnet system (11) away from the shroud base (32) is arranged in the center of the shroud base (32), and that the thickness of the spacer and the depth T of the rim segments (37.1) are adjusted to one another so as to exclude direct contact between the magnet system (11) and the shroud base (32) while the magnet system (11) and loudspeaker frame (12) are being joined.

* * * * *